US011573062B2

(12) United States Patent
Haas et al.

(10) Patent No.: US 11,573,062 B2
(45) Date of Patent: Feb. 7, 2023

(54) ENERGY STORAGE SYSTEM FOR A BOW

(71) Applicant: FeraDyne Outdoors, LLC, Superior, WI (US)

(72) Inventors: Matthew Peter Haas, Duluth, MN (US); Mark W. Beck, Foxboro, WI (US); Benjamin D. Blosser, Corydon, KY (US)

(73) Assignee: FERADYNE OUTDOORS, LLC, Superior, WI (US)

( * ) Notice: Subject to any disclaimer, the term of this patent is extended or adjusted under 35 U.S.C. 154(b) by 0 days.

(21) Appl. No.: 17/424,821

(22) PCT Filed: Mar. 26, 2020

(86) PCT No.: PCT/US2020/025043

§ 371 (c)(1),
(2) Date: Jul. 21, 2021

(87) PCT Pub. No.: WO2020/205451

PCT Pub. Date: Oct. 8, 2020

(65) Prior Publication Data

US 2022/0136797 A1 May 5, 2022

Related U.S. Application Data

(60) Provisional application No. 62/885,540, filed on Aug. 12, 2019, provisional application No. 62/830,208, filed on Apr. 5, 2019.

(51) Int. Cl.
*F41B 5/10* (2006.01)
*F41B 5/12* (2006.01)

(52) U.S. Cl.
CPC ..... *F41B 5/123* (2013.01); *F41B 5/105* (2013.01)

(58) Field of Classification Search
CPC ..... F41B 5/10; F41B 5/105; F41B 5/123
See application file for complete search history.

(56) References Cited

U.S. PATENT DOCUMENTS

| | | | | |
|---|---|---|---|---|
| 9,470,471 | B2 * | 10/2016 | DeBole | F41B 5/0094 |
| 9,528,789 | B2 * | 12/2016 | Biafore, Jr. | F41B 5/1442 |
| 9,945,634 | B1 * | 4/2018 | Isenhower | F41B 5/123 |
| 10,126,088 | B2 * | 11/2018 | Yehle | F41B 5/105 |
| 10,139,191 | B1 * | 11/2018 | Kempf | F41B 5/123 |
| 2014/0261358 | A1 * | 9/2014 | Pulkrabek | F41B 5/105 29/428 |
| 2015/0204631 | A1 * | 7/2015 | McPherson | F41B 5/123 124/25 |
| 2015/0233664 | A1 * | 8/2015 | McPherson | F41B 5/123 124/25 |
| 2017/0038173 | A1 * | 2/2017 | Yehle | F41B 5/105 |

* cited by examiner

*Primary Examiner* — John A Ricci
(74) *Attorney, Agent, or Firm* — Greenberg Traurig, LLP

(57) ABSTRACT

An energy storage system for a bow, the system defined at least in part by a riser, a first and second limb each having a first end coupled to the riser, a first and second wheel disposed at a second end of respective first and second limbs, a first and second power cord each having a first end coupled to the riser and a second end coupled to respective first and second wheels, and a string extending between and coupled to the first and second wheels.

26 Claims, 9 Drawing Sheets

ENERGY STORAGE SYSTEM FOR A BOW

CROSS-REFERENCE TO RELATED APPLICATIONS

Pursuant to 35 U.S.C. § 371, this patent application is a U.S. National Stage patent application ("371 Application") of International Patent Application No. PCT/US20/25043 filed Mar. 26, 2020, which claims the benefit of U.S. Provisional Patent Application No. 62/830,208 filed Apr. 5, 2019, and of U.S. Provisional Patent Application No. 62/885,540 filed Aug. 12, 2019, which are herein incorporated by reference in their entirety.

STATEMENT REGARDING FEDERALLY SPONSORED RESEARCH OR DEVELOPMENT

Not applicable.

TECHNICAL FIELD

The instant disclosure relates archery. Particularly, the instant disclosure relates to archery bows. Specifically, the instant disclosure pertains to compound bows, e.g., crossbows.

BACKGROUND

Bows are used for target shooting and as a weapon for hunting. Compound bows include cams configured for increasing the mechanical advantage for drawing of the bowstring. Some bow designs include cams configured for decreasing the draw force near the full draw position. In some bow designs, power cables are used for synchronizing the rotation of the cams.

In recent years, bow preference has shifted from a forward-draw configuration to a reverse-draw configuration. One advantage of the reverse-draw configuration over the forward-draw configuration is the increase in the power stroke.

Reverse-draw configurations include at least one pair of cables extending between a pair of cams disposed on either side of a barrel or track or rail of the bow. Such cables are often referred to as "power cables" by those skilled in the art. The cables and the cams are arranged such that when the bowstring is drawn, the cam on one side of the barrel rotates to pull-in the cam on the other side towards the barrel. For example, when the bowstring is drawn, the cam on the right side of the barrel rotates to pull-in the other cam, i.e., the cam on the left side of the barrel, towards the barrel while the cam on the left side of the barrel rotates to pull-in the cam on the right side of the barrel towards the barrel. This arrangement requires the cables to cross each other and, in most configuration, the cables are in frictional contact at the point of intersection. As is well known in the art, such configurations induce "cam lean" as well as wear on the cable.

Conventional cams used in reverse-draw bow configurations have one or more spiral grooves for receiving at least one cable when the bowstring is drawn and/or released. In some instances, one or more cable or string is wrapped around in the one or more spiral grooves of the cam while the bowstring is not drawn, and the cable or string unwraps from the spiral groove of the cam when the bowstring is drawn. In other instances, one or more cable or string wraps around onto or into the one or more spiral grooves of the cam when the bowstring is drawn, and the cable or string unwraps from the spiral groove of the cam when the drawn bowstring is released. As will be apparent to one of ordinary skill in the art, providing spiraling grooves increases the size of a cam.

SUMMARY

A non-limiting exemplary embodiment of a bow includes a riser, first and second limbs coupled to the riser, first and second wheels rotatably coupled to the first and second limbs, respectively, first and second power cords, and a string. In some embodiments, the first and second limbs each include a first end and a second end, wherein the first end of each limb is coupled to the riser. In certain embodiments, the first and second wheels are rotatably coupled to the first and second limbs, respectively, proximate their respective second ends. In some embodiments, the first and second wheels each include an upper pulley and a lower pulley, a spool extending between and affixed to the upper and lower pulleys, a stud disposed between and coupled to at least one of the upper and lower pulleys, and a post disposed between and coupled to at least one of the upper and lower pulleys. In certain embodiments, the first and second power cords each include a first end and a second end. In some embodiments the first end of each power cord is coupled to the riser, and the second end of the first and second power cord, respectively, is coupled to the stud of the first and second wheel. In certain embodiments, the string includes a middle section, a first section coupled to a first end of the middle section, and a second section coupled to a second end of the middle section. In some embodiments, the first and second sections of the string each include a first end and a second end. In certain embodiments, the first end of the first and second sections, respectively, is coupled to the upper pulley of the first and second wheel, and the second end of the first and second sections, respectively, is coupled to the lower pulley of the first and second wheel.

and

Figure 13:
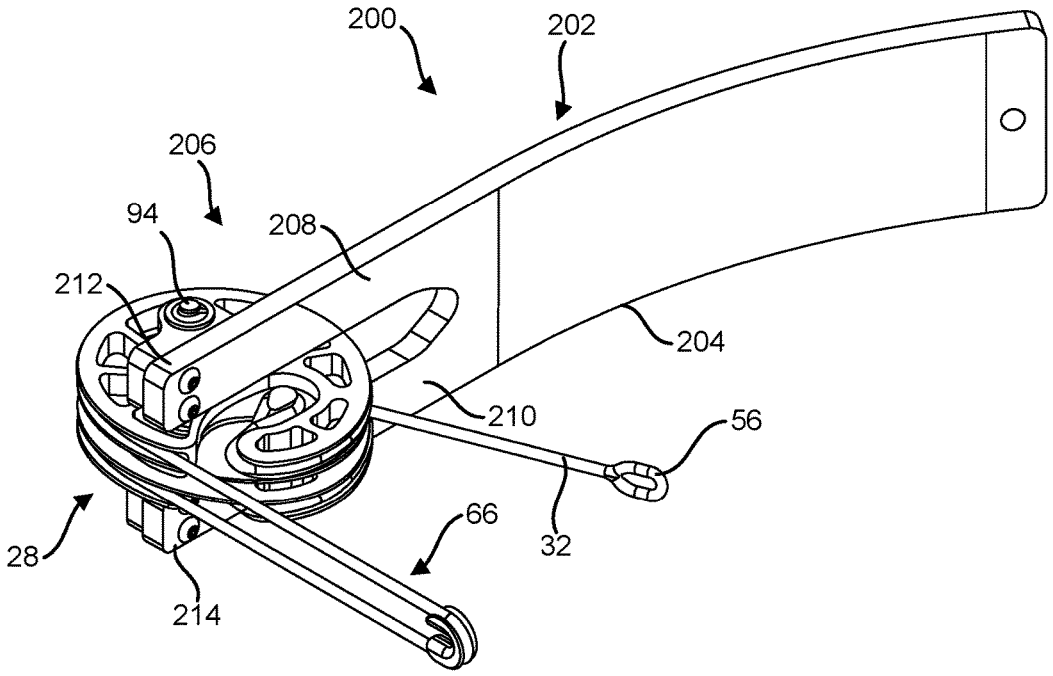
FIG. 13 is a perspective view of a section of a non-limiting exemplary embodiment of a limb for another non-limiting exemplary embodiment of an energy storage system for a bow.
Figure 14:
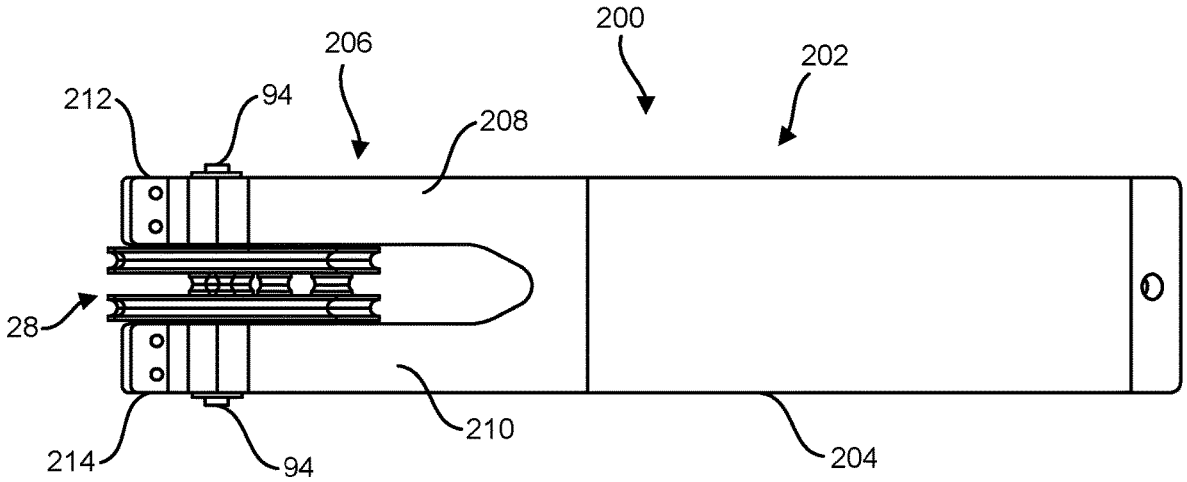

FIG. 14 is a side view of FIG. 13.

DETAILED DESCRIPTION

One or more non-limiting exemplary embodiments are disclosed herein with reference to the accompanying drawings, wherein like numerals indicate like, but not necessarily identical, elements. It should be clearly understood that the embodiments described with reference to the drawings are merely exemplary in that any one or more of them may be implemented in alternative manner as may become apparent to a person of ordinary skills. The figures, wherein some features may have been exaggerated or minimized to illustrate details of particular components, are not necessarily to scale. Specific structural and/or functional features and details disclosed herein are not to be construed as limiting, but should rather be treated as a basis for teaching one of ordinary skills. There is no intent, implied or otherwise, to limit the disclosure in any way, shape or form to the embodiments illustrated and described herein. Accordingly, any and all variants for providing structures and/or functionalities similar to those described herein are considered as being within the metes and bounds of the instant disclosure.

Figure 1:
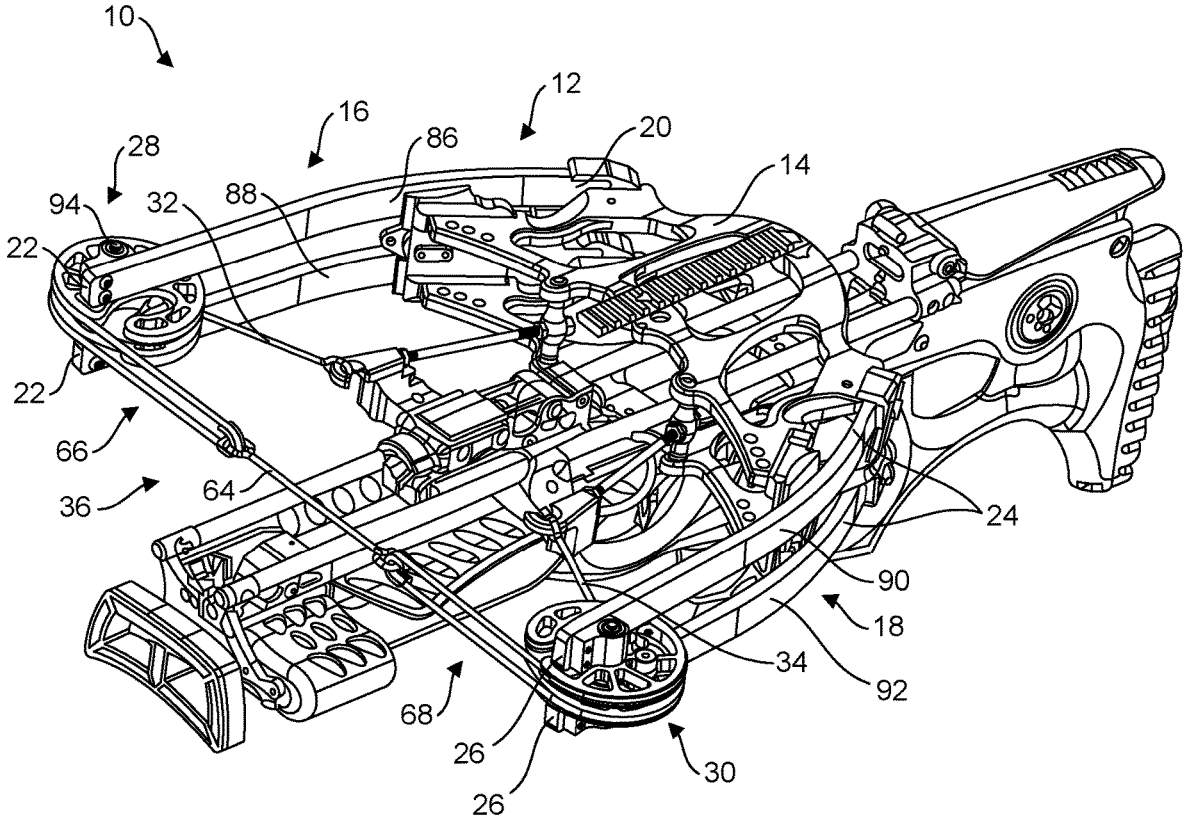
FIG. 1 is a perspective view of a non-limiting exemplary embodiment of a bow of the instant disclosure.
Figure 2:
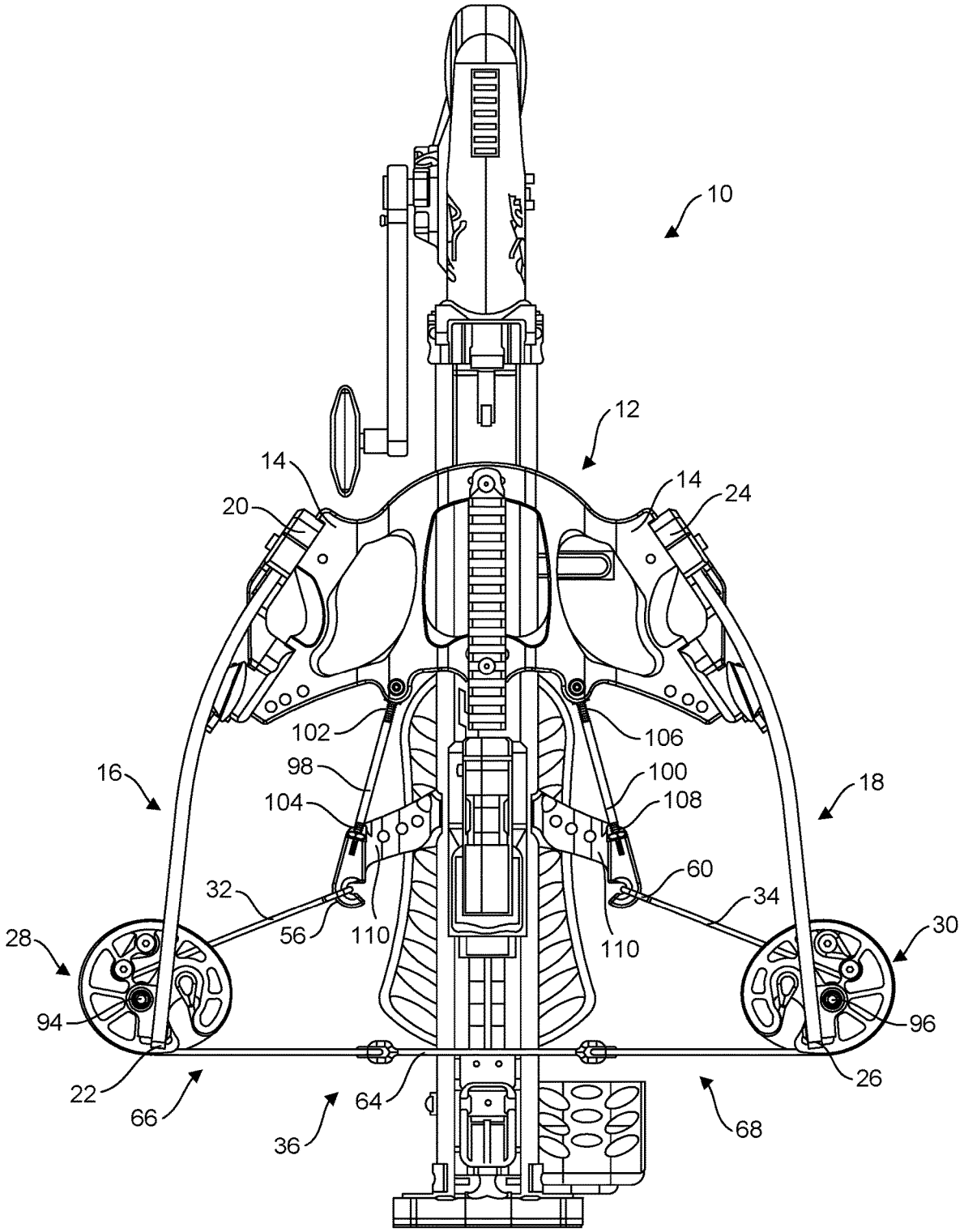
FIG. 2 is a top view of the bow of FIG. 1.
Figure 3:
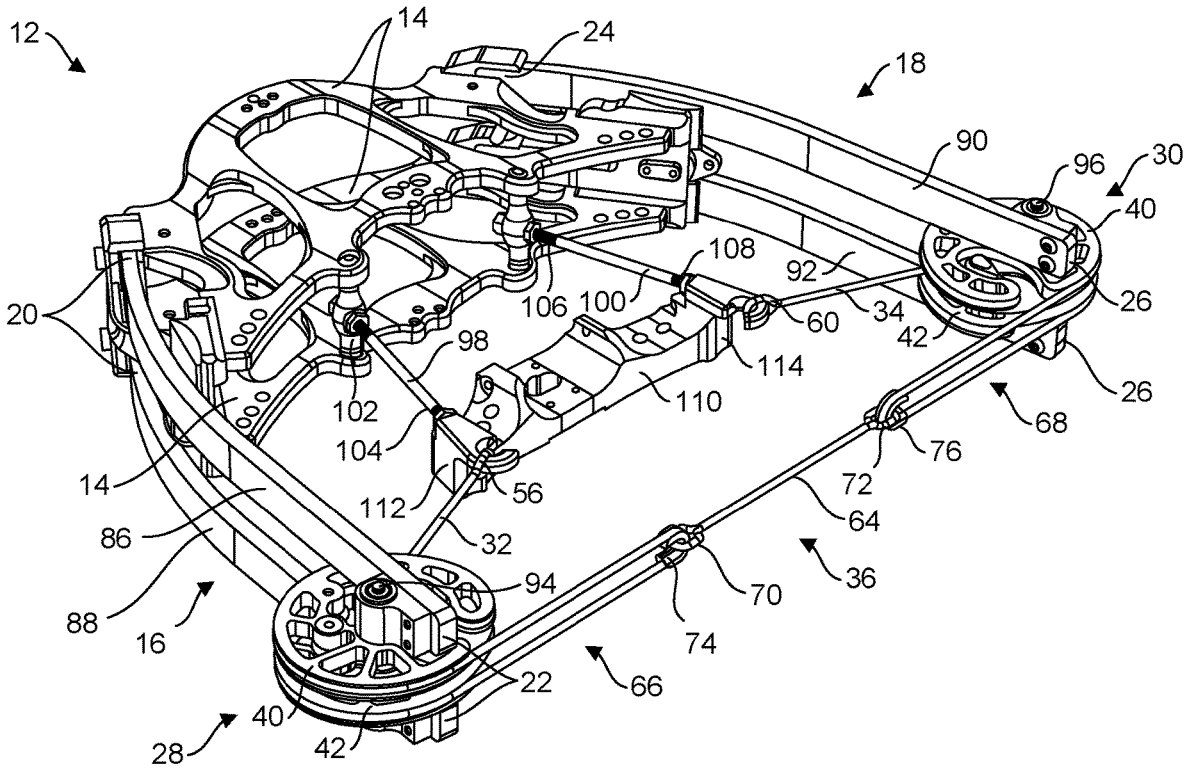
FIG. 3 is a perspective view of a non-limiting exemplary embodiment of an energy storage system for the bow of FIG. 1.
Figure 4:
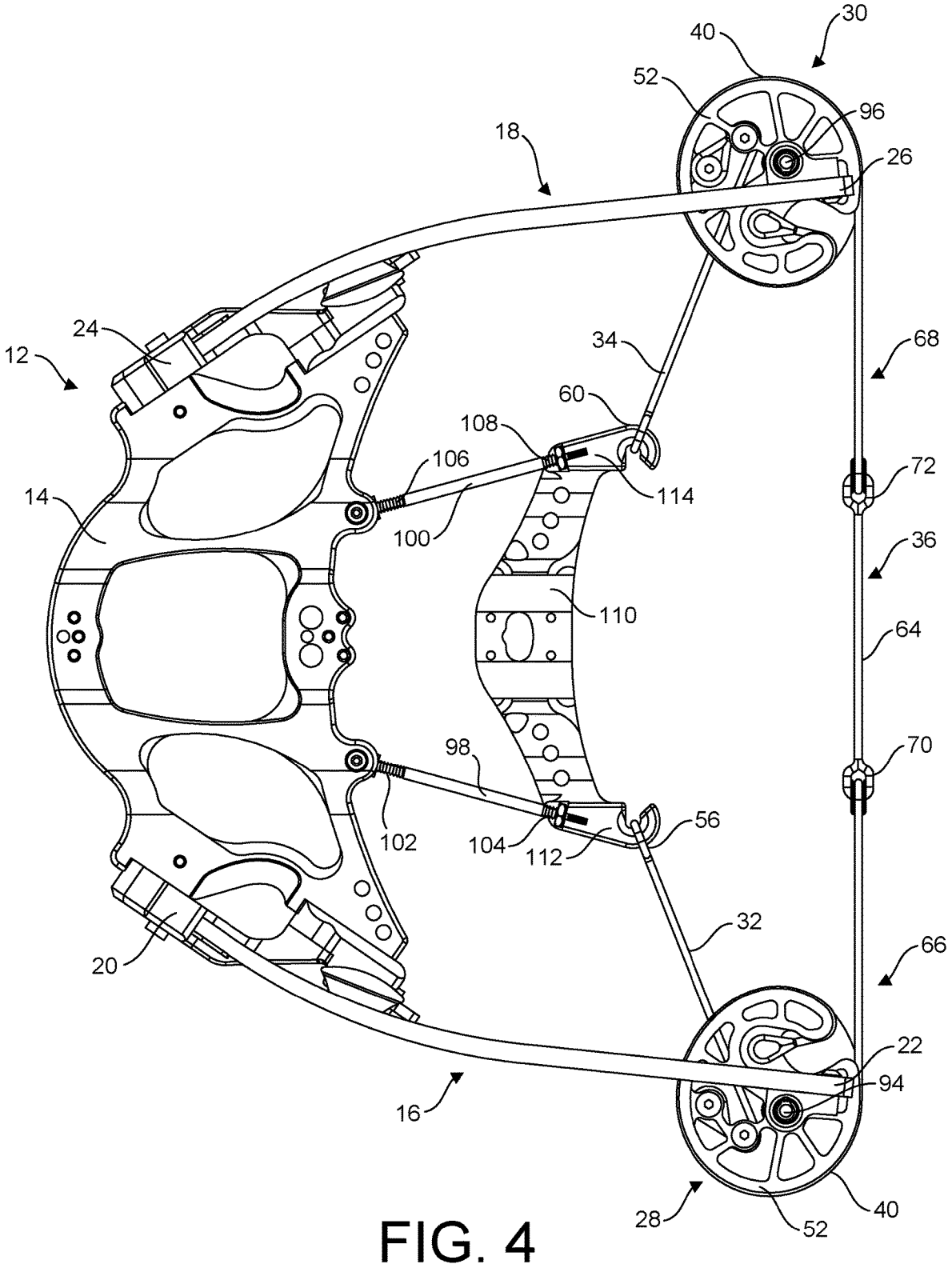
FIG. 4 is a top view of the energy storage system of FIG. 3.

FIGS. 1 and 2, respectively, are a perspective view and a top view of a non-limiting exemplary embodiment of a bow 10 of the instant disclosure; and FIGS. 3 and 4, respectively, are a perspective view and a top view of a non-limiting exemplary embodiment of an energy storage system 12 for the bow 10. In some embodiments, the energy storage system 12 is defined at least in part by a riser 14; and first and second limbs 16 and 18. In certain embodiments, the first limb 16 extends between first and second ends 20 and 22; and the second limb 18 extends between first and second ends 24 and 26. In some embodiments, the first ends 20 and 24 of the first and second limbs 16 and 18, respectively, are coupled to or affixed to the riser 14. In certain embodiments, the energy storage system 12 includes first and second wheels 28 and 30. In some embodiments, the first wheel 28 is rotatably coupled to the first limb 16 proximate the second end 22 thereof; and the second wheel 30 is rotatably coupled to the second limb 18 proximate the second end 26 thereof. In certain embodiments, the energy storage system 12 includes a first power cord 32 extending between, and coupled to or affixed to, the riser 14 and the first wheel 28; and a second power cord 34 extending between, and coupled to or affixed to, the riser 14 and the second wheel 30. In some embodiments, the energy storage system 12 includes a string 36 extending between, and coupled to or affixed to, the first and second wheels 28 and 30.

In a non-limiting exemplary embodiment, the first and second wheels 28 and 30 are substantially similar. Therefore, in the following, the first and second wheels 28 and 30 will be described in the singular with reference to "a wheel" or "the wheel" 38. Accordingly, the following description of "a wheel" or "the wheel" 38 applies equally to both the first and the second wheel 28 and 30.

Figure 5:
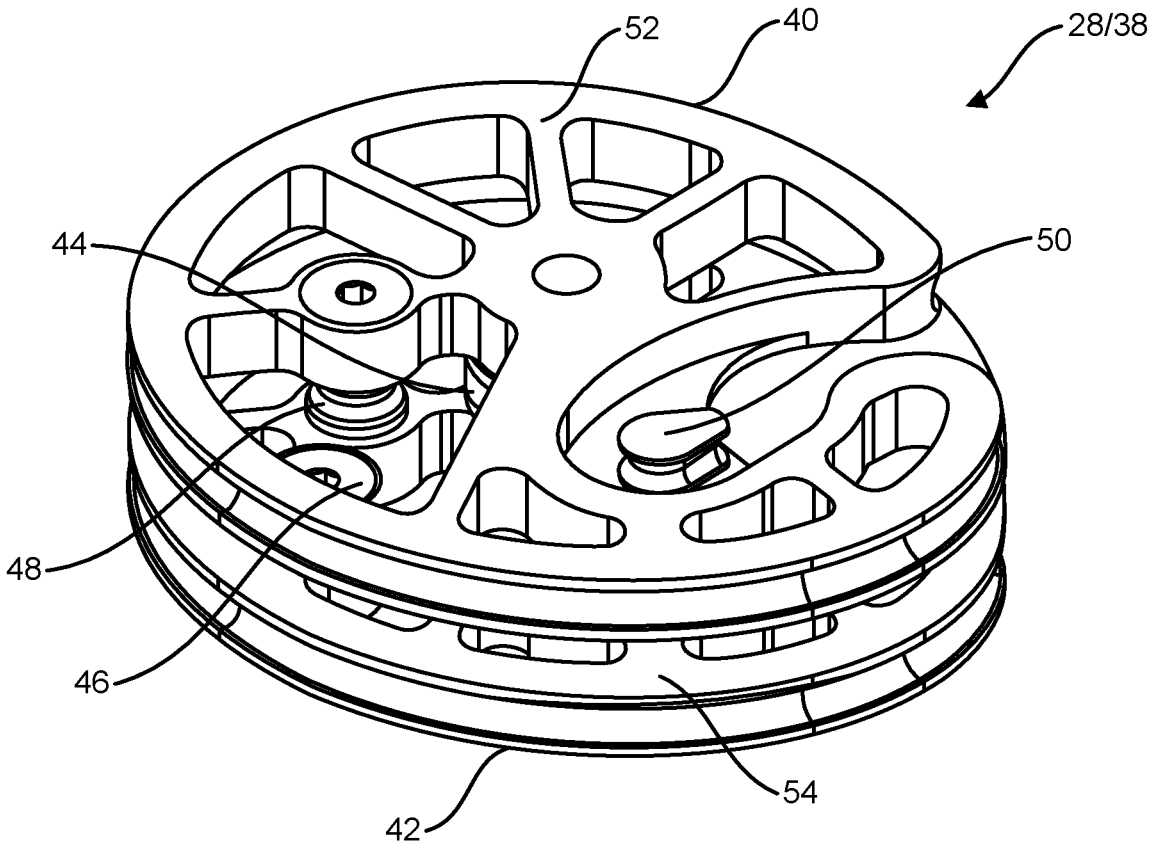
FIG. 5 is a perspective view of a non-limiting exemplary embodiment of a component for the energy storage system of FIG. 3.
Figure 6:
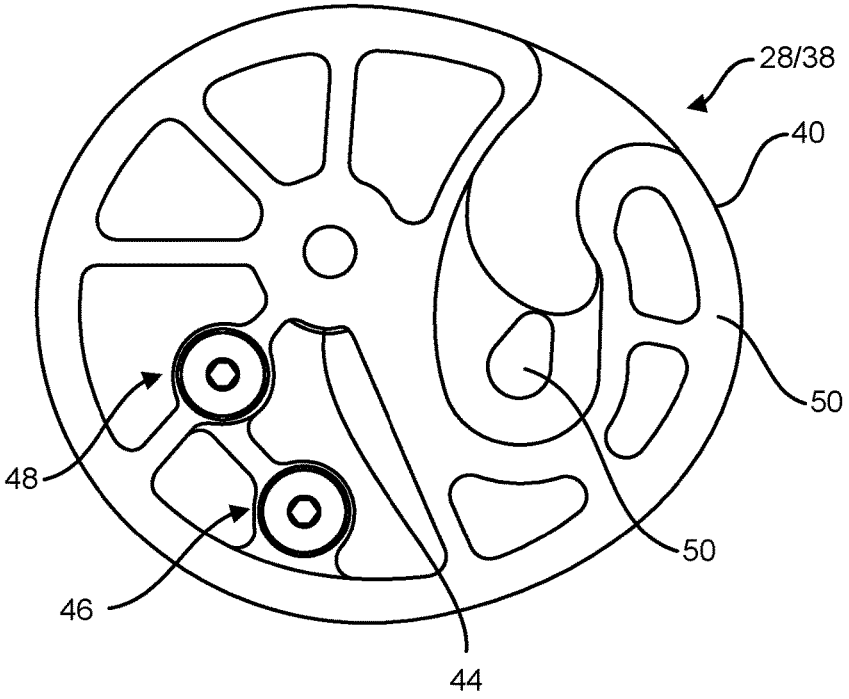
FIG. 6 is a top view of the component of FIG. 5.
Figure 7:
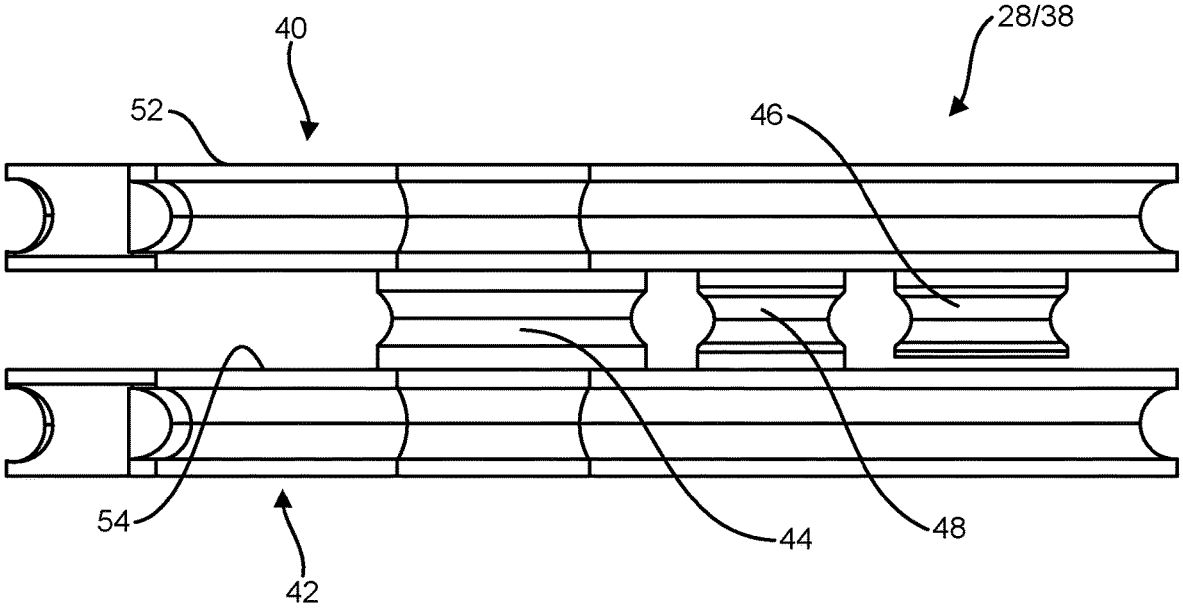
FIG. 7 is a side view of the component of FIG. 5.

FIG. 5 is a perspective view of a non-limiting exemplary embodiment of a wheel 38 associated with the energy storage system 12; and FIGS. 6 and 7, respectively, are a top view and a side view of the wheel 38. In some embodiments, the wheel 38 is defined at least in part by upper and lower pulleys 40 and 42, respectively. In certain embodiments, the wheel 38 includes a spool 44 extending between, and affixed to or coupled to, the upper and lower pulleys 40 and 42. In some embodiments, the wheel 38 includes a stud 46 disposed between, and coupled to or affixed to, at least one of the upper and lower pulleys 40 and 42. In certain embodiments, the wheel 38 includes a post 48 disposed between, and coupled to or affixed to, at least one of the upper and lower pulleys 40 and 42. In some embodiments, the upper pulley 40 includes a post or a stud 50 on an outer side 52 opposite an inner side that faces the lower pulley 42. While not illustrated, the lower pulley 42 also includes a post or a stud on an outer side opposite an inner side 54 that faces the upper pulley 40.

Figure 8:
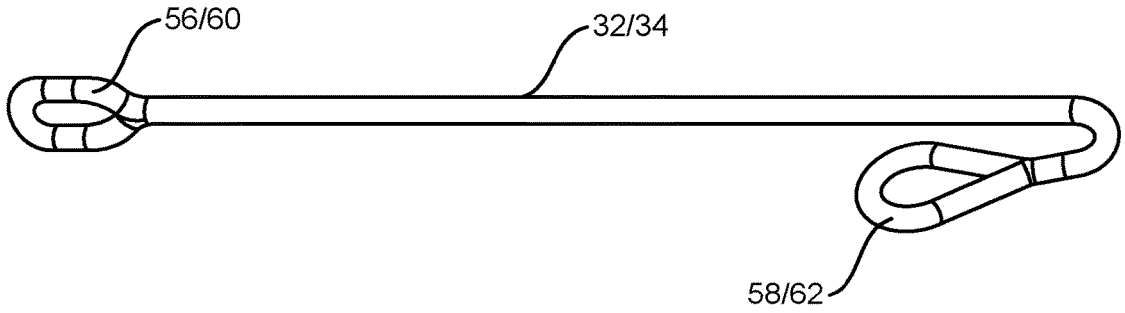
FIG. 8 is a perspective view of a non-limiting exemplary embodiment of a power cord for the energy storage system of FIG. 3.

In a non-limiting exemplary embodiment, the first and second power cords 32 and 34 are substantially similar. FIG. 8 is a perspective view of a non-limiting exemplary embodiment of the first and second power cords 32 and 34. In some embodiments, the first power cord 32 extends between first and second ends 56 and 58; and the second power cord 34 extends between first and second ends 60 and 62. In certain embodiments, the first power cord 32 and the riser 14 are coupled at first end 56; and the second power cord 34 and the riser 14 are coupled at first end 60. In some embodiments, the second end 58 of the first power cord 32 is coupled to a stud, such as stud 46, of the first wheel 28; and the second end 62 of the second power cord 34 is coupled to a stud, such as stud 46, of the second wheel 30. The stud 46, as described herein above, is associated with the wheel 38, and since the first and second wheels 28 and 30 and the wheel 38 are substantially similar, therefore the first and second wheels 28 and 30 each include a stud, such as stud 46.

Figure 9:
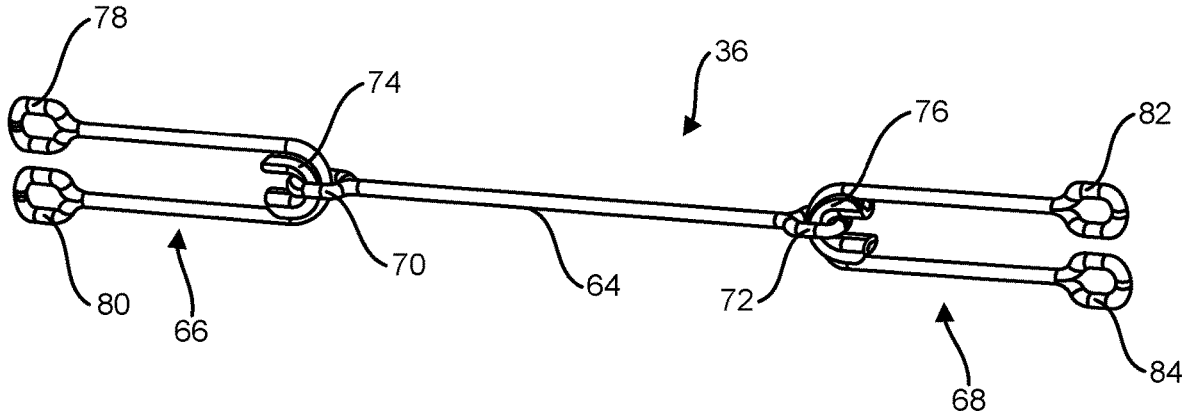
FIG. 9 is a perspective view of a non-limiting exemplary embodiment of a string for the energy storage system of FIG. 3.

FIG. 9 is a perspective view of a non-limiting exemplary embodiment of the string 36. In some embodiments, the string 36 includes a middle section 64, and substantially similar first and second sections 66 and 68. The first section 66 is coupled to the middle section 64 at the first end 70 thereof; and the second section 68 is coupled to the middle section 64 at the second end 72 thereof. In certain embodiments, a first coupler 74 is provided for coupling the middle section 64 and the first section 66; and a second coupler 76 is provided for coupling the middle section 64 and the second section 68. In some embodiments, the first and second couplers 74 and 76 are yoke splitters as are well known in the art and to a person of ordinary skill. It should be clearly understood that there is no intent, implied or otherwise, to limit the structure of the first and second couplers 74 and 76 to that illustrated and/or to yoke splitters. Any and all other forms of couplers as are known in the art or known to a person of ordinary skill or become known or available in the future are considered as being within the metes and bounds of the instant disclosure.

Figure 10:
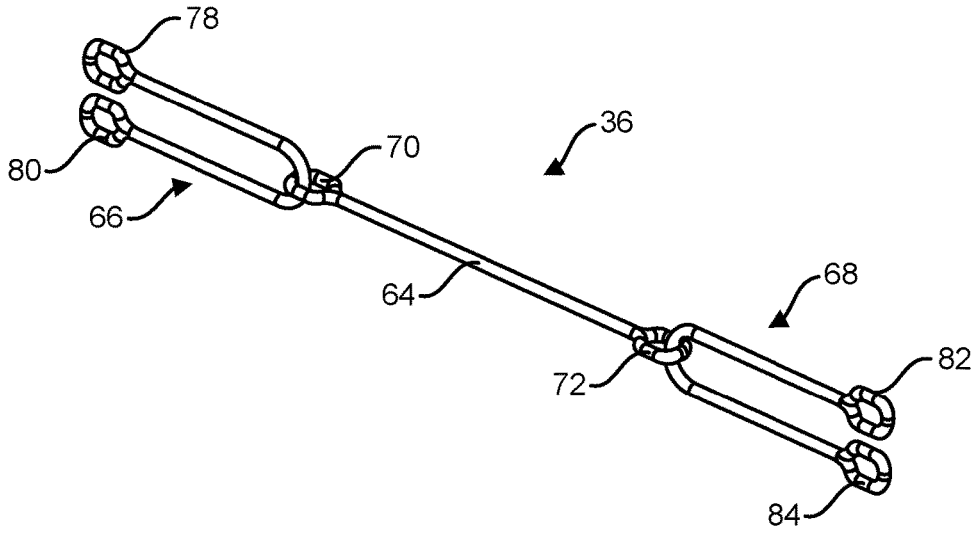
FIG. 10 is a perspective view of another non-limiting exemplary embodiment of a string for the energy storage system of FIG. 3.

FIG. 10 is a perspective view of another non-limiting exemplary embodiment of the string 36. The embodiments of the string 36 illustrated in FIGS. 9 and 10 are substantially similar in that both embodiments have substantially similar middle, first, and second sections 64, 66, and 68. One primary difference between the two illustrated embodiments of the string 36 is the manner in which the first section 66 and the middle section 64 are coupled at the first end 70, and the manner in which the second section 68 and the middle section 64 are coupled at the second end 72. In the exemplary string 36 illustrated in FIG. 10, the first section 66 and the middle section 64 are coupled by extending the first section 66 through a loop at the first end 70; and the second section 68 and the middle section 64 are coupled by extending the second section 68 through a loop at the second end 72. In contrast first and second couplers 74 and 76 are provided for the string 36 illustrated in FIG. 9.

In a non-limiting exemplary embodiment, first and second wheels 28 and 30 are substantially similar to exemplary wheel 38. Accordingly, first and second wheels 28 and 30 each include an upper pulley, such as the exemplary upper pulley 40; a lower pulley, such as the exemplary lower pulley 42; a spool, such as the exemplary spool 44; a stud, such as the exemplary stud 46; a post, such as the exemplary post 48; and a stud or a post, such as the exemplary stud or post 50, on their respective outer sides, such as exemplary outer side 52.

Figure 11:
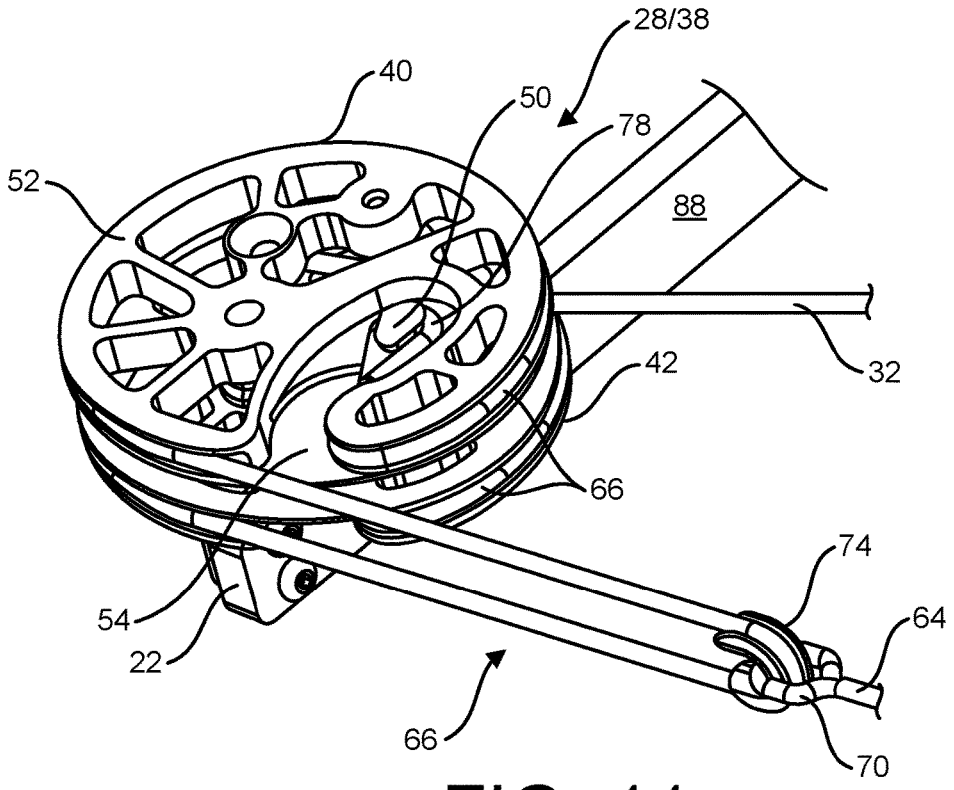
FIG. 11 is a close-up perspective view of a portion of the energy storage system of FIG. 3.
Figure 12:
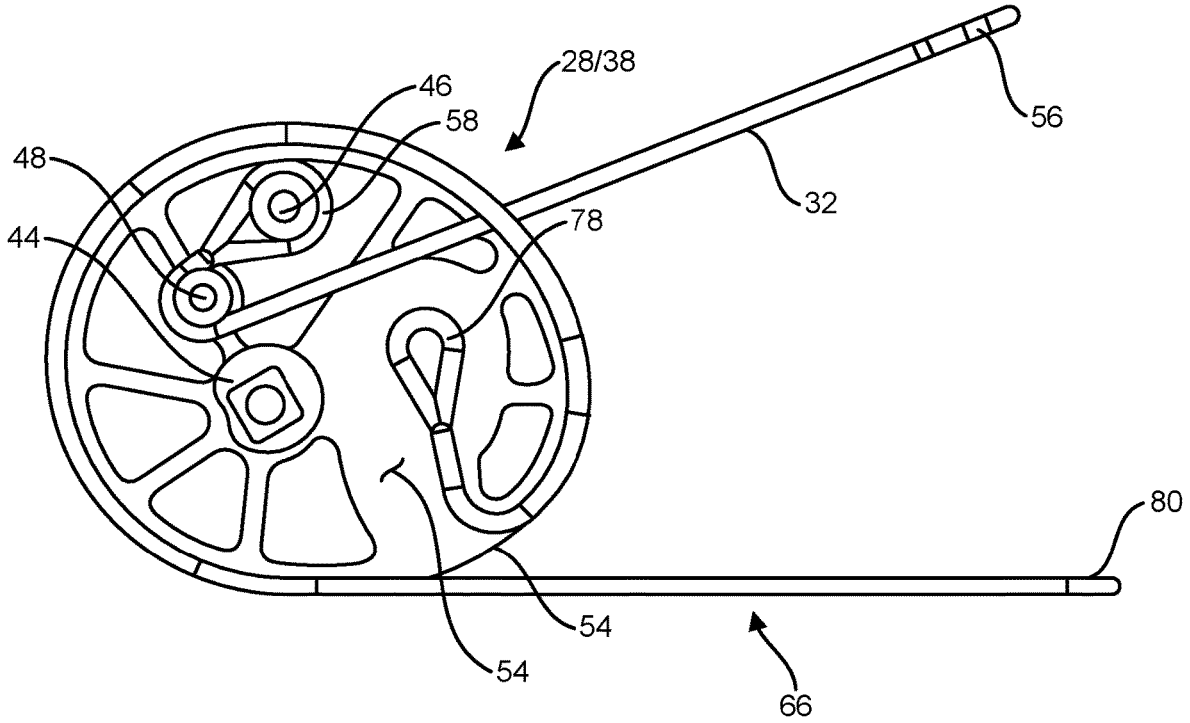
FIG. 12 is a top view of the portion illustrated in FIG. 11 with some components removed.

FIG. 11 is a perspective view of a section of the energy storage system 12 in the vicinity of the first wheel 28 rotatably coupled to at least a portion of the first limb 16 proximate the second end 22 thereof. Some components of the energy storage system 12 in this section have been removed or not shown for illustrating the coupling between the first wheel 28, the first section 66 of the string 36, and the first power cord 32 proximate the second end 58 thereof. FIG. 12 is a top view of the section illustrated in FIG. 11 with additional components removed or not shown for illustrating the coupling in further detail.

In a non-limiting exemplary embodiment, the first section 66 of the string 36 extends between first and second ends 78 and 80. In some embodiments, the first end 78 of the first section 66 is coupled to or affixed to or anchored at the stud or post (such as exemplary stud or post 50) on the outer side (such as exemplary outer side 52) of the upper pulley (such as exemplary upper pulley 40) of the first wheel 28, and at least a portion of the first section 66 extending away from the first end 78 wraps around the upper pulley of the first wheel 28; and the second end 80 of the first section 66 is coupled to or affixed to or anchored at the stud or post (such as exemplary stud or post 50) on the outer side (not shown) of the lower pulley (such as exemplary lower pulley 42) of the first wheel 28, and at least a portion of the first section 66 extending away from the second end 80 wraps around the lower pulley (such as exemplary lower pulley 42) of the first wheel 28.

Likewise, in a non-limiting exemplary embodiment, the second section 68 of the string 36 extends between first and second ends 82 and 84. In some embodiments, the first end 82 of the second section 68 is coupled to or affixed to or anchored at the stud or post (such as exemplary stud or post 50) on the outer side (such as exemplary outer side 52) of the upper pulley (such as exemplary upper pulley 40) of the second wheel 30, and at least a portion of the second section 68 extending away from the first end 82 wraps around the upper pulley of the second wheel 30; and the second end 84 of the second section 68 is coupled to or affixed to or anchored at the stud or post (such as exemplary stud or post 50) on the outer side (not shown) of the lower pulley (such as exemplary lower pulley 42) of the second wheel 30, and at least a portion of the second section 68 extending away from the second end 84 wraps around the lower pulley of the second wheel 30.

In a non-limiting exemplary embodiment, the first power cord 32 extends between first and second ends 56 and 58. In some embodiments, the first power cord 32 and the riser 14 are coupled at first end 56. In certain embodiments, the second end 58 of the first power cord 32 is coupled to or affixed to or anchored at the stud (such as exemplary stud 46) of the first wheel 28. In a non-limiting exemplary embodiment, at least a portion of the first power cord 32 extending away from the second end 58 wraps around the post (such as exemplary post 48) of the first wheel 28 and extends through or between the post and the spool (such as exemplary spool 44) of the first wheel 28.

Likewise, in a non-limiting exemplary embodiment, the second power cord 34 extends between first and second ends 60 and 62. In some embodiments, the second power cord 34 and the riser 14 are coupled at first end 60. In certain embodiments, the second end 62 of the second power cord 34 is coupled to or affixed to or anchored at the stud (such as exemplary stud 46) of the second wheel 30. In a non-limiting exemplary embodiment, at least a portion of the second power cord 34 extending away from the second end 62 wraps around the post (such as exemplary post 48) of the second wheel 30 and extends through or between the post and the spool (such as exemplary spool 44) of the second wheel 30.

In a non-limiting exemplary embodiment, the first limb 16 is defined at least in part by upper and lower limbs 86 and 88. In some embodiments, the first wheel 28 is rotatably coupled to the first limb 16 proximate the second end 22 thereof. In certain embodiments, the first wheel 28 is disposed between the upper and lower limbs 86 and 88 of the first limb 16. In some embodiments, a first axle or rod 94 extends through the spool (such as exemplary spool 44) of the first wheel 28 and away from the outer sides (such as exemplary outer side 52) of the upper and lower pulleys (such as exemplary upper and lower pulleys 40 and 42) of the first wheel 28. In certain embodiments, the first axle or rod 94 extending out of the first wheel 28 is fixedly or rotatably coupled to the upper and lower limbs 86 and 88 of the first limb 16.

Likewise, in a non-limiting exemplary embodiment, the second limb 18 is defined at least in part by upper and lower limbs 90 and 92. In some embodiments, the second wheel 30 is rotatably coupled to the second limb 18 proximate the second end 26 thereof. In certain embodiments, the second wheel 30 is disposed between the upper and lower limbs 90 and 92 of the second limb 18. In some embodiments, a second axle or rod 96 extends through the spool (such as exemplary spool 44) of the second wheel 30 and away from the outer sides (such as exemplary outer side 52) of the upper and lower pulleys (such as exemplary upper and lower pulleys 40 and 42) of the second wheel 30. In certain embodiments, the second axle or rod 96 extending out of the second wheel 30 is fixedly or rotatably coupled to the upper and lower limbs 90 and 92 of the second limb 18.

In a non-limiting exemplary embodiment, when at least a portion of the middle section 64 of the string 36 is pulled in the proximal direction, such as towards the user of bow 10, at least a portion of the first section 66 of the string 36 unwraps from the upper and lower pulleys (such as exemplary upper and lower pulleys 40 and 42) of the first wheel 28. Concurrently, at least a portion of the second section 68 of the string 36 unwraps from the upper and lower pulleys (such as exemplary upper and lower pulleys 40 and 42) of the second wheel 30.

In a non-limiting exemplary embodiment, upon releasing the string 36 that has been pulled in the proximal direction, at least a portion of the first section 66 of the string 36 wraps onto or wraps around the upper and lower pulleys (such as exemplary upper and lower pulleys 40 and 42) of the first wheel 28. Concurrently, at least a portion of the second section 68 of the string 36 wraps onto or wraps around the upper and lower pulleys (such as exemplary upper and lower pulleys 40 and 42) of the second wheel 30.

In a non-limiting exemplary embodiment, when at least a portion of the middle section 64 of the string 36 is pulled in the proximal direction, such as towards the user of bow 10, at least a portion of the first power cord 32 wraps onto the spool (such as exemplary spool 44) of the first wheel 28. Concurrently, at least a portion of the second power cord 34 wraps onto the spool (such as exemplary spool 44) of the second wheel 30.

In a non-limiting exemplary embodiment, upon releasing the string 36 that has been pulled in the proximal direction, at least a portion of the first power cord 32 unwraps from the spool (such as exemplary spool 44) of the first wheel 28. Concurrently, at least a portion of the second power cord 34 unwraps from the spool (such as exemplary spool 44) of the second wheel 30.

In a non-limiting exemplary embodiment, pulling at least a portion of the middle section 64 of the string 36 in the proximal direction, such as towards the user of bow 10, the second ends 22 and 26 of the first and second limbs 16 and 18 displace or move or translate towards each other. In some embodiments, the second ends 22 and 26 are displaced or translate or move towards each other along the same plane. In certain embodiments, the approximate centers of the first and second wheel 28 and 30, for instance at the spool (such as exemplary spool 44) of the first and second wheel 28 and 30 are displaced or translate or move towards each other along substantially the same plane. In other words, the approximate center of the first wheel 28 does not move along a first plane that is substantially above or below a second plane along which the approximate center of the second wheel 30 moves. That is, the "cam lean", as is known in the art, is eliminated or minimized.

In a non-limiting exemplary embodiment, the energy storage system 12 includes first and second tension rods 98 and 100. In some embodiments, the first tension rod 98 extends between first and second ends 102 and 104; and the second tension rod 100 extends between first and second ends 106 and 108. In certain embodiments, the first and second tension rods 98 and 100 couple the first and second power cords 32 and 34, respectively, to the riser 14. In some embodiments, the first tension rod 98 extends between the riser 14 and the first end 56 of the first power cord 32; and the second tension rod 100 extends between the riser 14 and the first end 60 of the second power cord 34. In certain embodiments, the first end 102 of the first tension rod 98 is coupled to or attached to or affixed to the riser 14; and the second end 104 of the first tension rod 98 is coupled to the first end 56 of the first power cord 32. Likewise, in a non-limiting exemplary embodiment, the first end 106 of the second tension rod 100 is coupled to or attached to or affixed to the riser 14; and the second end 108 of the second tension rod 100 is coupled to the first end 60 of the second power cord 34.

In a non-limiting exemplary embodiment, the energy storage system 12 includes a cable hanger 110 having first and second ends 112 and 114. In some embodiments, the first end 112 of the cable hanger 110 is coupled to the first tension rod 98 proximate the second end 104 thereof; and the second end 114 of the cable hanger 110 is coupled to the second tension rod 100 proximate the second end 108 thereof.

In a non-limiting exemplary embodiment, the cable hanger 110 is coupled to a barrel or a rail or a track of the bow 10.

In a non-limiting exemplary embodiment, a length of the first tension rod 98 and a length of the second tension rod 100 is adjustable.

In a non-limiting exemplary embodiment, the first and second power cords 32 and 34 are directly coupled to or attached to or affixed to the riser 14. In other words, the first ends 56 and 60 of the first and second power cords 32 and 34, respectively, are coupled to or attached to or affixed to the riser 14 without any intervening parts or components or structures between the riser 14 and the first ends 56 and 60.

In a non-limiting exemplary embodiment, the first and second power cords 32 and 34 are directly coupled to or attached to or affixed to a barrel or a rail or a track of the bow 10. In other words, the first ends 56 and 60 of the first and second power cords 32 and 34, respectively, are coupled to or attached to or affixed to the barrel or the rail or the track of the bow 10.

In a non-limiting exemplary embodiment of the bow 10, the string 36 is distal of the first and second axles or rods 94 and 96. In other words, in some embodiments, the string 36 extending between the first and second wheels 28 and 30 traverses a plane located distal of a plane traversed by or extending between both the first and second axles or rods 94 and 96. In another non-limiting exemplary embodiment of the bow (not shown), the string 36 is proximal of the first and second axles or rods 94 and 96. In other words, in some embodiments, the string 36 extending between the first and second wheels 28 and 30 traverses a plane located proximal of a plane traversed by or extending between both the first and second axles or rods 94 and 96. In yet another non-limiting exemplary embodiment, the bow 10 is configured as a reverse draw bow as is well known in the art. In another non-limiting exemplary embodiment, the bow 10 is configured to eliminate or at least minimize "cam lean" as understood by a person skilled in the art.

In a non-limiting exemplary embodiment, the first and second wheels 28 and 30 each have one or more single-track grooves. In other words, the first and second wheels 28 and 30 are devoid of spiraling or helical grooves or tracks. In a non-limiting exemplary embodiment, the first and second wheels 28 and 30 are substantially similar.

In a non-limiting exemplary embodiment, the first and second wheels 28 and 30 are configured as first and second cams as are known in the art or to a person of ordinary skills. In a non-limiting exemplary embodiment, the first and second cams each have one or more single-track grooves. In other words, the first and second cams are devoid of spiraling or helical grooves or tracks. In a non-limiting exemplary embodiment, the first and second cams are substantially similar.

FIGS. 13 and 14, respectively, illustrate a section 200 of a non-limiting exemplary embodiment of another first limb 202 for another non-limiting exemplary embodiment of an energy storage system (not shown) for a bow. In FIG. 14, the first power cord 32 and the first section 66 of the string 36 are not illustrated in the interest of clarity. In contrast to the first limb 16, the first limb 202 illustrated in FIGS. 13 and 14 is a unitary or singular piece 204 up until proximate a distal region or end 206 thereof. The unitary or singular limb 204 illustrated in FIGS. 13 and 14 has a first end (not shown) coupled to a riser (not shown) and extends in the distal direction as a unitary or single piece 204 and bifurcates into an upper limb fork or upper limb 208 and a lower limb fork or lower limb 210 in the distal region 206. The first wheel 28 is disposed between and coupled to the upper and lower limbs 208 and 210 proximate respective distal ends 212 and 214. From the foregoing illustrations and description of the energy storage system 12, it will be readily apparent that first and second limbs 16 and 18 are substantially similar to each other. Likewise, while not shown, this exemplary embodiment of another energy storage system includes a second limb substantially similar to the first limb 202.

In view thereof, modified and/or alternate configurations of the non-limiting exemplary embodiments illustrated and described herein may become apparent or obvious to one of ordinary skill. All such variations are considered as being within the metes and bounds of the instant disclosure. For instance, while reference may have been made to particular feature(s) and/or function(s), this disclosure is considered to also encompass any and all equivalents providing functionalities similar to those described herein with reference to the accompanying drawings. Accordingly, the spirit, scope and intent of the instant disclosure embraces all variations. Consequently, the metes and bounds of the instant disclosure are defined by the appended claims and any and all equivalents thereof.

What is claimed is:

1. A bow, comprising:

a riser;

a first limb and a second limb, each limb comprising a first end and a second end, wherein the first end of each limb is coupled to the riser;

a first wheel rotatably coupled to the first limb proximate the second end thereof, the first wheel comprising:

an upper pulley and a lower pulley;

a spool extending between and affixed to the upper and lower pulleys;

a stud disposed between and affixed to at least one of the upper and lower pulleys; and a post disposed between and affixed to at least one of the upper and lower pulleys;

a second wheel rotatably coupled to the second limb proximate the second end thereof, the second wheel comprising:

an upper pulley and a lower pulley;

a spool extending between and affixed to the upper and lower pulleys;

a stud disposed between and affixed to at least one of the upper and lower pulleys; and a post disposed between and affixed to at least one of the upper and lower pulleys;

a first power cord, comprising:

a first end coupled to the riser; and a second end coupled to the stud of the first wheel;

a second power cord, comprising:

a first end coupled to the riser; and a second end coupled to the stud of the second wheel; and a string, comprising:

a middle section comprising a first end and a second end;

a first section coupled to the middle section at the first end thereof, the first section comprising:

a first end coupled to the upper pulley of the first wheel; and a second end coupled to the lower pulley of the first wheel; and a second section coupled to the middle section at the second end thereof, the second section comprising:

a first end coupled to the upper pulley of the second wheel; and a second end coupled to the lower pulley of the second wheel.

2. The bow of claim 1, wherein at least a portion of the first section of the string wraps around the upper and lower pulleys of the first wheel;

at least a portion of the second section of the string wraps around the upper and lower pulleys of the second wheel;

at least a portion of the first power cord wraps around the post of the first wheel and extends between the spool and the post of the first wheel; and at least a portion of the second power cord wraps around the post of the second wheel and extends between the spool and the post of the second wheel.

3. The bow of claim 2, wherein at least a portion of the first and second power cords wrap onto the spool of their respective first and second wheel when at least a portion of the middle section of the string is pulled in the proximal direction.

4. The bow of claim 3, wherein at least a portion of the first and second power cords unwrap from the spool of their respective first and second wheel when the middle section of the string is released.

5. The bow of claim 3, wherein the second ends of the first and second limbs displace towards each other.

6. The bow of claim 2, wherein at least a portion of the first and second sections of the string unwrap from the upper and lower pulleys of their respective first and second wheel when at least a portion of the middle section of the string is pulled in the proximal direction.

7. The bow of claim 6, wherein at least a portion of the first and second power cords wrap onto the spool of their respective first and second wheel.

8. The bow of claim 6, wherein the second ends of the first and second limbs displace towards each other.

9. The bow of claim 6, wherein at least a portion of the first and second sections of the string wrap onto the upper and lower pulleys of their respective first and second wheel when the middle section of the string is released.

10. The bow of claim 9, wherein at least a portion of the first and second power cords unwrap from the spool of their respective first and second wheel.

11. The bow of claim 1, comprising:

a first coupler for coupling the middle and first sections of the string to each other; and a second coupler for coupling the middle and second sections of the string to each other.

12. The bow of claim 11, wherein:

the first coupler is a first yoke splitter; and the second coupler is a second yoke splitter.

13. The bow of claim 1, wherein the first section of the string extends through a loop at the first end of the middle section; and the second section of the string extends through a loop at the second end of the middle section.

14. The bow of claim 1, wherein the first limb comprises an upper limb and a lower limb;

the first wheel is disposed between the upper and lower limbs of the first limb;

the second limb comprises an upper limb and a lower limb; and the second wheel is disposed between the upper and lower limbs of the second limb.

15. The bow of claim 14, comprising:

a first axle extending through the spool of the first wheel, the first axle rotatably coupling the first limb and the first wheel to each other; and a second axle extending through the spool of the second wheel, the second axle rotatably coupling the second limb and the second wheel to each other.

16. The bow of claim 15, wherein the string is distal of the first and second axles when the string is not drawn.

17. The bow of claim 15, wherein the string is proximal of the first and second axles when the string is not drawn.

18. The bow of claim 1, comprising a reverse draw crossbow.

19. The bow of claim 1, configured to eliminate or minimize cam lean.

20. The bow of claim 1, comprising:

a first tension rod for coupling the first power cord to the riser, the first tension rod comprising:

a first end coupled to the riser; and a second end coupled to the first end of the first power cord; and a second tension rod for coupling the second power cord to the riser, the second tension rod comprising:

a first end coupled to the riser; and a second end coupled to the first end of the second power cord.

21. The bow of claim 20, wherein:

a length of the first tension rod is adjustable; and a length of the second tension rod is adjustable.

22. The bow of claim 20, comprising a cable hanger comprising:

a first end coupled to the first tension rod proximate the second end thereof; and a second end coupled to the second tension rod proximate the second end thereof.

23. The bow of claim 22, wherein:

a length of the first tension rod is adjustable; and a length of the second tension rod is adjustable.

24. The bow of claim 1, comprising an energy storage system defined at least in part by:

the first and second limbs;

the first and second wheels;

the first and second power cords; and the string.

25. The bow of claim 1, wherein the first and the second wheels are configured as cams.

26. The bow of claim 1, wherein the first and the second wheels are devoid of spiraling grooves.

* * * * *